US011096418B2

(12) United States Patent
Sarian

(10) Patent No.: US 11,096,418 B2
(45) Date of Patent: Aug. 24, 2021

(54) DEVICE FOR SMOKING A SMOKABLE MATERIAL

(71) Applicant: ARIES, Bourg-les-Valence (FR)

(72) Inventor: Sarkis Sarian, Bourg-les-Valence (FR)

(73) Assignee: ARIES, Bourg-les-Valence (FR)

( * ) Notice: Subject to any disclaimer, the term of this patent is extended or adjusted under 35 U.S.C. 154(b) by 0 days.

(21) Appl. No.: 17/054,482

(22) PCT Filed: May 13, 2019

(86) PCT No.: PCT/EP2019/062240
§ 371 (c)(1),
(2) Date: Nov. 10, 2020

(87) PCT Pub. No.: WO2019/215348
PCT Pub. Date: Nov. 14, 2019

(65) Prior Publication Data

US 2021/0145047 A1 May 20, 2021

(30) Foreign Application Priority Data

May 11, 2018 (FR) ..... 18 53988

(51) Int. Cl.
*A24F 1/30* (2006.01)
*A24D 1/14* (2006.01)

(52) U.S. Cl.
CPC . *A24F 1/30* (2013.01); *A24D 1/14* (2013.01)

(58) Field of Classification Search
CPC ..... A24F 1/30; A24D 1/14
See application file for complete search history.

(56) References Cited

U.S. PATENT DOCUMENTS

2011/0186060 A1* 8/2011 Saleh ..... A24F 1/30
131/173

FOREIGN PATENT DOCUMENTS

| | | | |
|---|---|---|---|
| EP | 3216357 | A1 | 9/2017 |
| GB | 2527597 | A | 12/2015 |
| WO | WO-2015/097424 | A1 | 7/2015 |
| WO | WO-2016/022695 | A1 | 2/2016 |

* cited by examiner

*Primary Examiner* — Eric Yaary
*Assistant Examiner* — Jennifer A Kessie
(74) *Attorney, Agent, or Firm* — Muncy, Geissler, Olds & Lowe, P.C.

(57) ABSTRACT

A smoking device for smoking a smokable material, the device comprising an upper bowl presenting a recess for having the smokable material positioned therein and a chimney opening out into the inside of the upper bowl in order to collect therefrom the smoke generated by combustion of said smokable material, said upper bowl including, inside the recess, positioning surfaces arranged to be capable of positioning a capsule inside the recess of said upper bowl, the capsule containing said smokable material. The smoking device includes a perforator adapted to make at least one first hot air flow opening through a wall of the capsule when the capsule is positioned in the recess of the upper bowl and is bearing against said positioning surfaces.

12 Claims, 7 Drawing Sheets

DEVICE FOR SMOKING A SMOKABLE MATERIAL

BACKGROUND OF THE INVENTION

The present invention relates to the general field of smoking devices for smoking a smokable material.

By way of example, such devices are known under the terms "waterpipe" or "hookah".

In general manner, a device for smoking a smokable material comprises an upper bowl presenting a recess for having the smokable material positioned therein and a chimney opening out into the inside of the upper bowl in order to collect therefrom the smoke generated by combustion of said smokable material.

Conventionally, manual filling of an upper bowl with the smokable material, e.g. tobacco or a mixture of tobacco and flavoring syrup, is performed manually. This filling is not easy since it is necessary to adjust the quantity of smokable material in the bowl while ensuring that the material is correctly positioned/aerated therein in order to allow good combustion.

It should be observed that the quantity of smokable material may vary depending on the user's taste and on the number of users seeking to smoke with the device.

For example, when the smokable material is molasses, i.e. a mixture of tobacco and flavoring syrup, it is necessary to provide about 20 grams (g) per user.

Adjusting the right quantity of molasses is not easy since such molasses is sticky.

Furthermore, the smokable material is generally packaged in the form of a packet containing a volume of smokable material that corresponds to a plurality of individual doses. Once the packet has been started, it is necessary to use up all of the smokable material in the packet quickly since otherwise it will dry out and lose its flavoring.

In order to remedy those drawbacks in part, patent document WO 2015/097424 A1 proposes packaging the smokable material in a prefabricated capsule for placing in a chamber that receives the capsule, the chamber being under an incandescent heat source.

That prefabricated capsule presents a plane top wall and a plane bottom wall, which plane walls are perforated in order to allow air and smoke to pass through the capsule while avoiding contact between the incandescent material of the heat source and the material for smoking. Membrane seals are stuck on the capsule in order to mask those perforations so as to conserve the smokable substance.

A drawback of that prior art device is that while it is being handled and used, the smokable material can pass through the perforations in the capsule and it runs the risk of giving rise to contamination and clogging.

OBJECT OF THE INVENTION

An object of the present invention is to provide a smoking device for smoking a smokable material that enables the above-mentioned problems of the prior art to be solved in full or in part.

SUMMARY OF THE INVENTION

To this end, in a first aspect of the invention, there is provided a smoking device for smoking a smokable material, the device comprising an upper bowl presenting a recess for having the smokable material positioned therein and a chimney opening out into the inside of the upper bowl in order to collect therefrom the smoke generated by combustion of said smokable material, said upper bowl including, inside the recess, positioning surfaces arranged to be capable of positioning a capsule inside the recess of said upper bowl, the capsule containing said smokable material.

The device of the invention is essentially characterized in that the smoking device includes a perforator adapted to make at least one first hot air flow opening through a wall of the capsule when the capsule is positioned in the recess of the upper bowl and is bearing against said positioning surfaces.

This first hot air flow opening is preferably connected to the chimney by a tubular portion extending from the wall of the capsule as far as the chimney, to which the tube is preferably connected in sealed manner.

By making use of a perforator that belongs to the device in order to make the first hot air flow opening while the capsule is in position in the recess of the upper bowl, perforation is obtained of a quality that is standardized, both in terms of the positioning of the perforation and in terms of the dimensions of the perforations, while limiting any risk of the smokable material spreading outside the upper bowl (e.g. while the capsule is being handled).

Thus, the device of the invention makes it easier to put the smokable material into place.

Furthermore, after use, the user can remove the capsule together with the smoked material it contains, thereby making it easier to clean the device.

Another advantage of the device of the invention is that the perforations made through the capsule remain uniform from one capsule to another.

Any need for user training is thus small since there is no longer any need to learn how to measure out and aerate the smokable material, nor is there any need to learn how to distribute the perforations over the wall of the capsule.

Combustion characteristics are thus made uniform.

In a second aspect, the invention provides an assembly comprising:

- a device in accordance with any of the embodiments of the device described in the present description; and
- a capsule presenting a wall defining an inside space internal to the capsule and containing a volume of smokable material, the capsule being placed inside the recess of said upper bowl and bearing against said positioning surfaces, the perforator passing through the wall of the capsule and defining at least one first hot air flow opening through the wall of the capsule.

In a preferred embodiment of the assembly of the invention, the perforator passes through the wall of the capsule and, in addition to said at least one first hot air flow opening, it also makes therein at least one second hot air flow opening, said at least one first hot air flow opening and said at least one second hot air flow opening being distinct from each other and being spaced apart from each other in such a manner as to form a baffle inside the capsule.

The baffle inside the capsule enhances uniform mixing between the smoke generated by the combustion of the material for smoking and the hot air admitted into the capsule.

In this preferred embodiment of the assembly of the invention, it is also possible for the capsule wall to comprise:

- a cup presenting a bottom and an annular peripheral wall of the cup, this annular peripheral cup wall defining a top opening of the cup; and
- a membrane seal closing the top opening of the cup;
- the volume of smokable material being placed in the cup against the bottom of the cup and defining a high level of smokable material inside the capsule, the high level being at a distance from said membrane seal;

said first hot air flow opening being an outlet opening for discharging smoke and being formed through the wall of the capsule above said high level of smokable material in the capsule; and said second hot air flow opening being an inlet opening for admitting air into the capsule and being formed through the wall of the capsule above the high level of smokable material in the capsule.

Having the first and second air flow openings made through the wall of the capsule above the high level of the smokable material enables this material to be kept away from the openings so as to avoid any of it escaping from the perforated capsule.

The membrane seal that extends across the top opening in order to close it constitutes a preferred zone for perforation. To do this, the membrane seal is preferably made out of a material that is easier to perforate/punch than is the material constituting the cup. The membrane seal is thus preferably made of a material of thickness that is smaller than the thickness of the material constituting the cup.

For example, the membrane seal and the cup may be made essentially out of aluminum. Thus, the membrane seal may then be an aluminum sheet of thickness less than 0.2 millimeters (mm), while the aluminum cup may be of thickness greater than 0.3 mm.

Preferably, the periphery of the membrane seal is fastened in sealed manner along a peripheral edge of the top opening of the cup, e.g. by crimping, by adhesive, by welding, or by soldering, or by using any other sealing means. The material from which the capsule is made is preferably of food quality.

For this purpose, a food protection varnish may be applied to the inside of the capsule so that the material for smoking comes into contact only with a varnished surface. The varnish may also be used for sticking the membrane seal to the rim of the cup.

In a third aspect, the invention provides a capsule presenting a wall defining an inside space internal to the capsule and containing a volume of smokable material, the wall of the capsule including:

a cup presenting a bottom and an annular peripheral wall of the cup, the annular peripheral wall defining a top opening of the cup;

a membrane seal closing the top opening of the cup;

the volume of smokable material being placed in the cup against the bottom of the cup and defining a high level of smokable material inside the capsule, the high level being at a distance from said membrane seal.

The capsule is characterized in that the bottom of the cup presents a central zone rising above the volume of smokable material and above said high level of smokable material.

The first opening can thus be formed through this central zone in the bottom of the cup while being above the high level of the volume of smokable material contained in the capsule.

By means of this central zone of the bottom of the cup that is located above the high level of the volume of smokable material, it is possible to discharge hot air and smoke via a first hot air flow opening that passes through the bottom of the capsule, and this can be done without any risk of shutting off the first opening.

Once the wall of the capsule has been perforated by this first opening, the smokable material may be set into combustion in order to generate the smoke that discharges via the first flow opening, with the smokable material remaining inside the capsule, spaced apart from the first opening.

This serves to limit any risk of the chimney being dirtied by the smokable material.

Furthermore, by means of this central zone that enables a first hot air flow opening to be located in a central zone of the capsule, air can pass through the capsule in a radial manner, going towards the central first opening.

This air moves along and over the high level of the volume of smokable material, going from the periphery of the capsule towards the central zone of the bottom where the first opening is located.

This air flow contributes to obtaining uniform combustion of the smokable material, while limiting any migration of this smokable material from the capsule.

In a fourth aspect, the invention provides a method of using a smoking device for smoking a smokable material in accordance with any of the embodiments of the device of the invention described in the present description.

This method comprises:

putting a capsule into place inside the recess of said upper bowl, the capsule presenting a wall defining an inside space internal to the capsule, the inside space containing a volume of smokable material, the wall of the capsule bearing against said positioning surfaces, the wall of the capsule comprising a cup and a membrane seal closing a top opening of the cup, the volume of smokable material being placed in said cup against the bottom of the cup and defining a high level of smokable material inside the capsule, the high level being at a distance from said membrane seal; and then generating a stream of hot air inside the capsule from a second hot air flow opening to a first hot air flow opening, these first and second hot air flow openings being formed through the wall of the capsule above the high level of smokable material and being spaced apart from each other.

This method presents the advantage of the above-described assembly, since it limits any risk of smokable material escaping from the capsule via said openings through the wall of the capsule.

Preferably, in the method of the invention, after the capsule has been put into place inside the recess of said upper bowl, the method includes making said first and second hot air flow openings, the first and second openings being made using a perforator forming a perforator lid that shuts, at least in part, an insertion passage for inserting the capsule into said recess of the upper bowl, the passage being formed between a zone outside said upper bowl and said recess of the upper bowl.

This is advantageous, since the capsule remains hermetically sealed until the moment the perforator lid is put into place to shut the passage to the recess of the upper bowl where the capsule is located. The flavors of the smokable material are thus preserved until the moment of consumption by the user.

Preferably, in this method of the invention, the perforator lid includes at least one tube provided with a cutting edge formed at a first terminal end of the tube and adapted to perforate the wall of the capsule, said first hot air flow opening being created by pushing the tube through the wall of the capsule. Once the capsule has been perforated in this way, the tube opens out outside the capsule facing the chimney so as to enable a stream of hot air to flow between the tube and the chimney, a lateral perforation in the tube then being situated inside the capsule above said a high level of smokable material, and each at least one second opening being formed through the membrane seal of the capsule by a cutting shape carried by said perforator lid.

The tube is thus shaped to allow hot air to flow inside the tube, between said lateral perforation, which is inside the capsule (being positioned in the recess of the upper bowl and bearing against said positioning surfaces), and said first terminal end of the tube that is outside the capsule, facing the smoke collection chimney.

BRIEF DESCRIPTION OF THE DRAWINGS

Other characteristics and advantages of the invention appear clearly from the following description that is given by way of nonlimiting indication and with reference to the accompanying drawings, in which.

DETAILED DESCRIPTION OF THE INVENTION

As mentioned above, the invention relates to a smoking device 1 for smoking a smokable material 2.

In this example, the smokable material 2 is tobacco or a mixture of tobacco and flavoring syrup, which mixture is also known as molasses.

Figure 1:
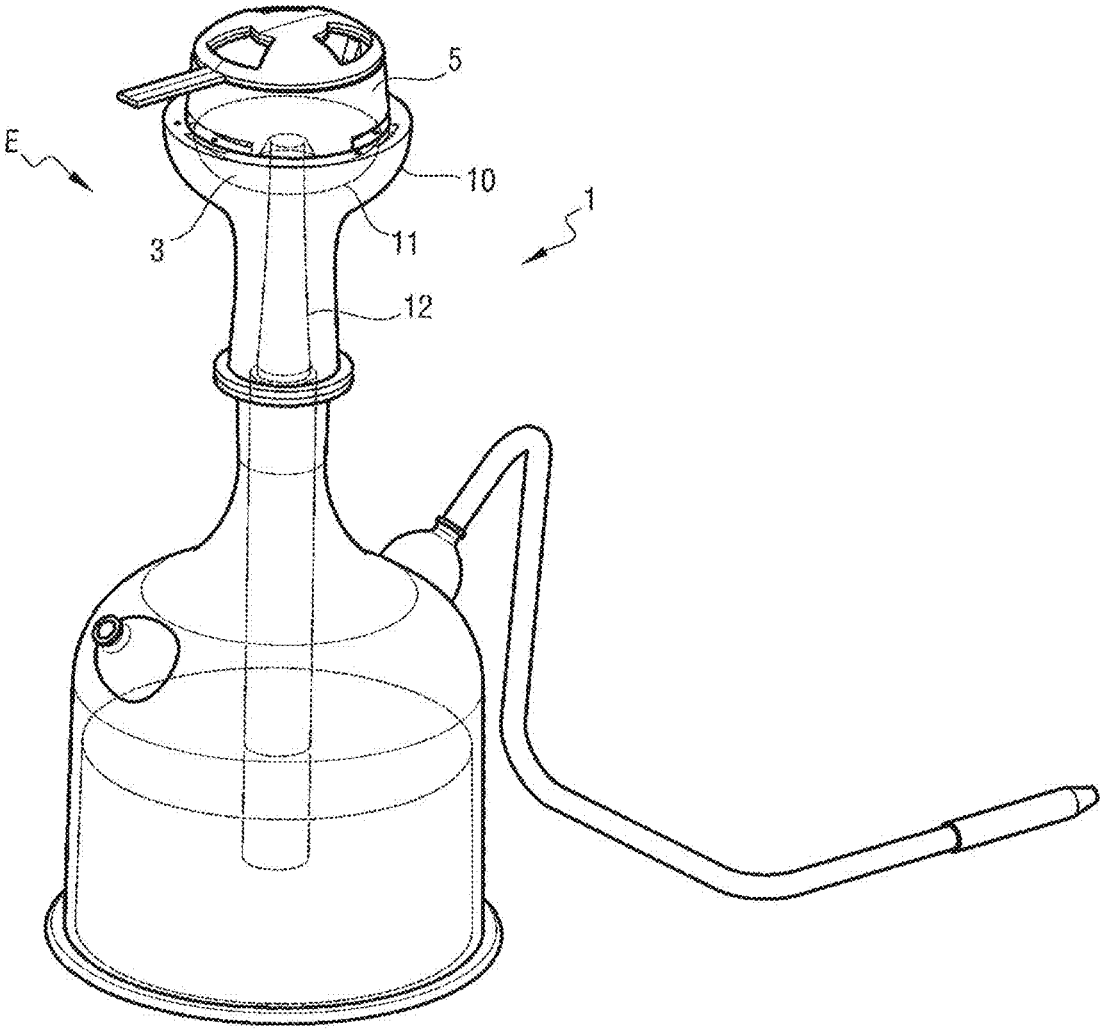
FIG. 1 is a perspective view of an assembly of the invention including the device of the invention.
Figure 2:
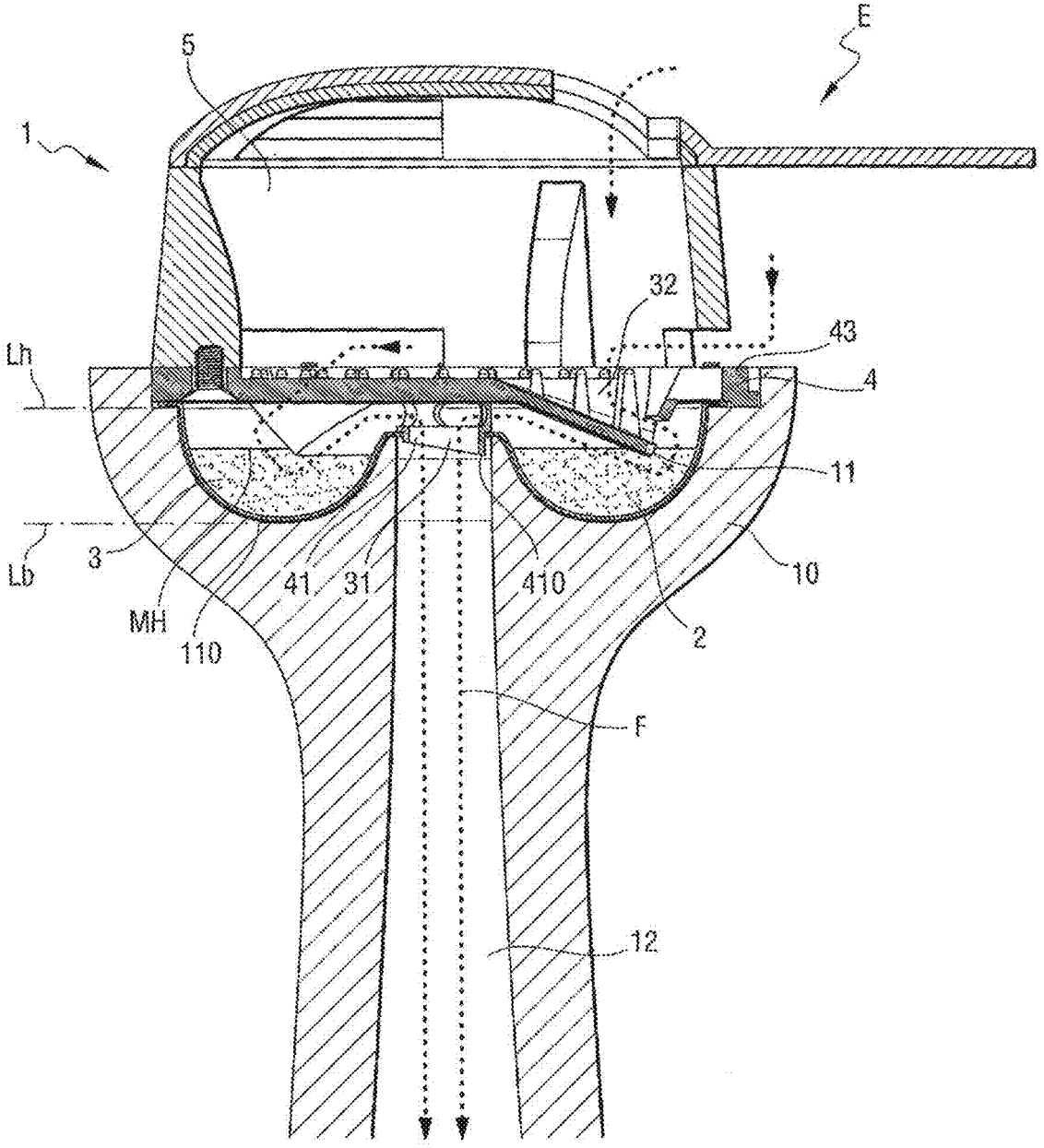
FIG. 2 is a section view of an assembly of the invention comprising a smoking device of the invention and a capsule of the invention containing a volume of smokable material.
Figure 3:
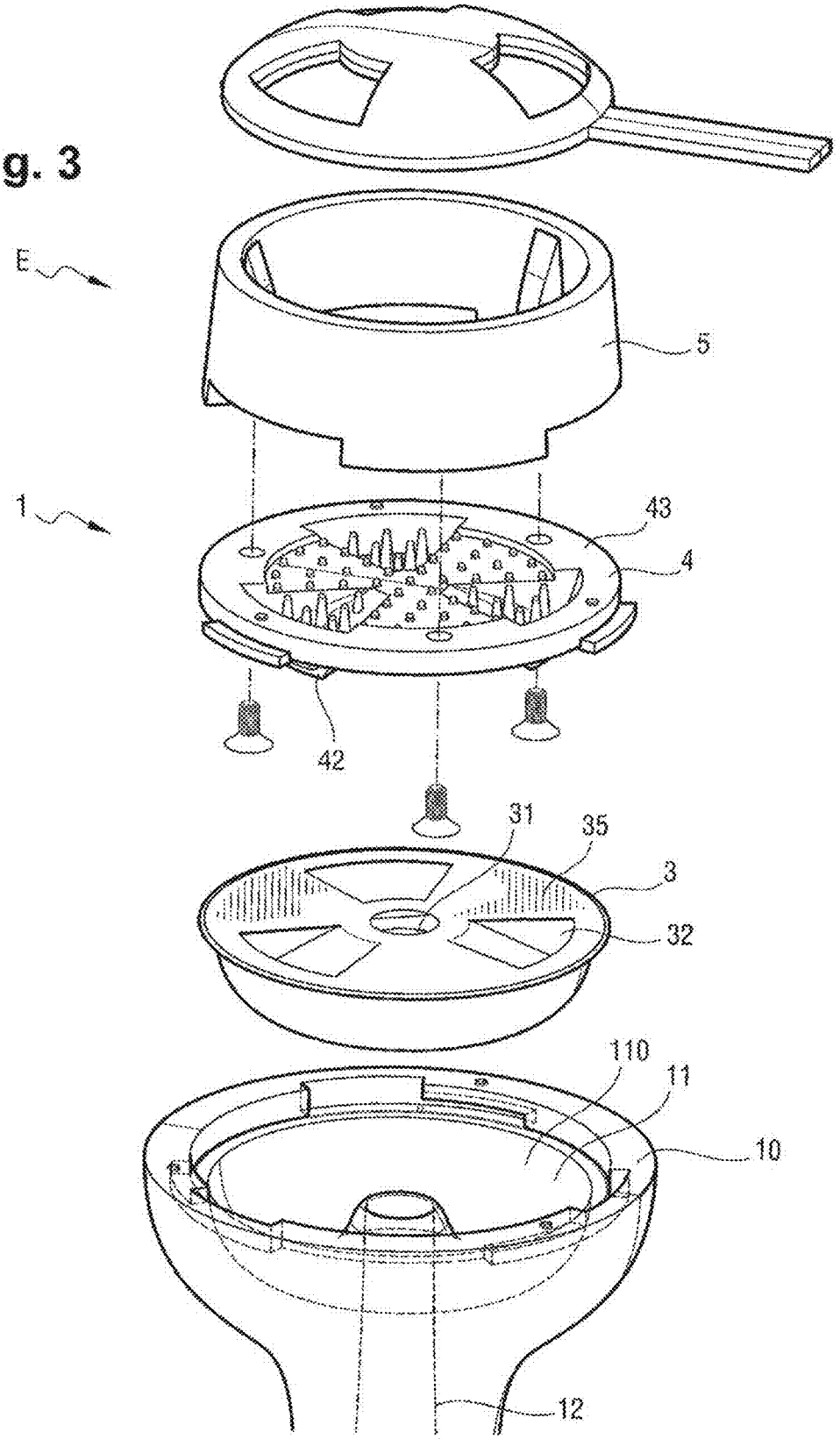
FIG. 3 is an exploded view of the assembly of the invention.
Figure 4:
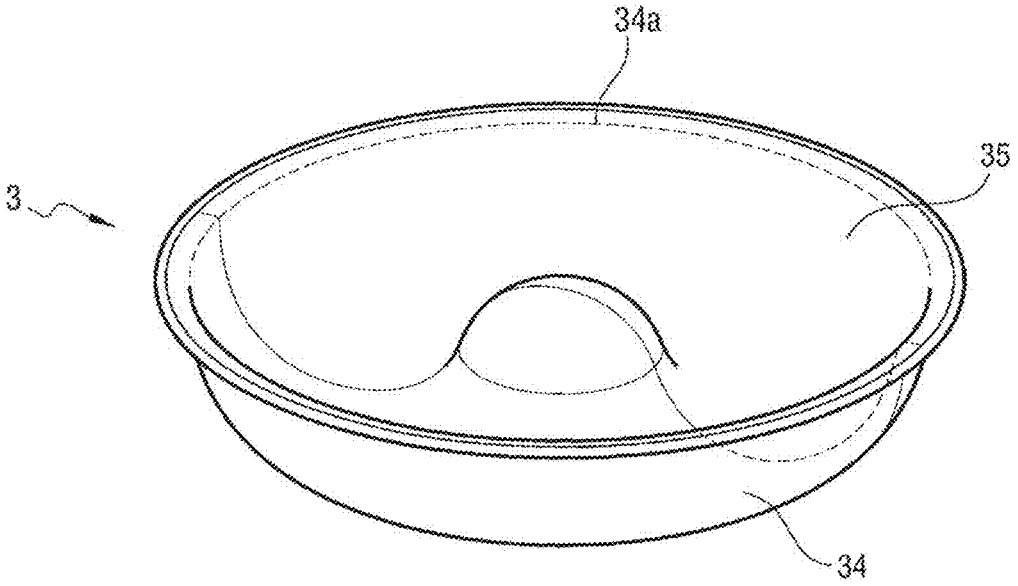
FIG. 4 is a perspective view of a capsule of the invention for use in the smoking device of the invention.
Figure 5:
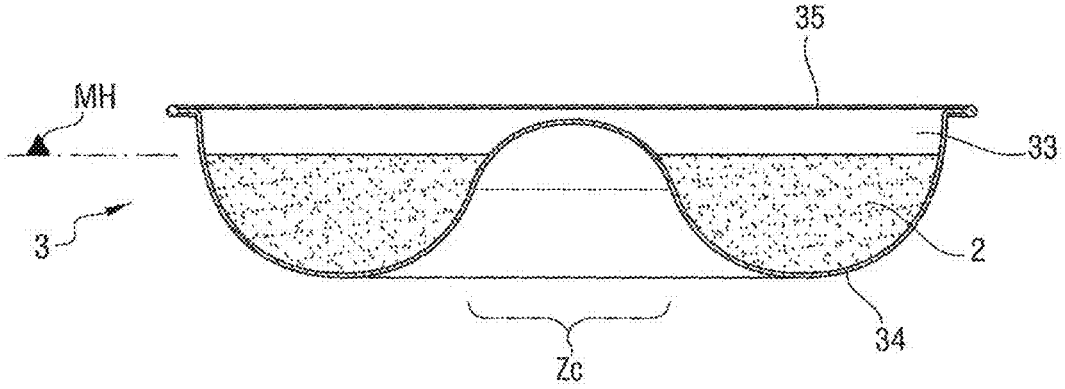
FIG. 5 is a cross-section view of the FIG. 4 capsule before it is used/perforated.

As shown in FIGS. 1, 2, and 3, the device 1 comprises an upper bowl 10 presenting a recess 11 for having the smokable material 2 positioned therein and a chimney 12 opening out into the inside of the upper bowl 10 in order to collect therefrom the smoke that is generated by combustion of said smokable material 2.

As can be understood from FIG. 1, the chimney 12 dips into a vase having a volume of liquid (specifically water) in its bottom, with the bottom end of the chimney 12 opening out into the liquid.

Where necessary, the chimney 12 may be made up of a plurality of separable parts.

A suction tube extends outside the vase, between a suction mouthpiece for putting into the user's mouth and a hose connecting the suction tube to the vase. This suction tube enables the user to suck in the air/smoke present in the vase, above the volume of liquid. By sucking in this way, the user generates suction in the vase that forces a stream of air to flow in the chimney 12 going from the internal recess in the upper bowl 10 towards the inside of the vase. This makes it possible to suck the smoke that comes from combustion of the smokable material 2 into the vase by passing through the liquid, which acts as a filter and as means for cooling the hot air/smoke.

The smoke inhaled by the user thus has improved taste characteristics.

Inside the recess 11, the upper bowl 10 includes positioning surfaces 110 arranged to be able to position/block a capsule 3 inside the recess 11 of said upper bowl so as to avoid it moving therein.

These positioning surfaces 110 are arranged to prevent the capsule moving in translation in a plane perpendicular to a direction for inserting the capsule into the recess, and to form an axial abutment for the capsule in the insertion direction.

In this example, the capsule 3 presses against said positioning surfaces 110 via the bottom outside face of the wall of the capsule, which wall is of a shape that is complementary to the positioning surfaces 110.

The bottom outside face of the capsule forms a surface of revolution that is W-shaped when observed in cross-section on a plane containing the axis of revolution.

In order to obtain better distribution and combustion of the material for smoking, the three vertices of the W-shape are rounded, i.e. they do not have any sharp angles.

The recess 110 formed inside the upper bowl 10 likewise forms a surface of revolution that is complementary in shape to the bottom outside face of the capsule, with only the central portion of this surface of revolution of the recess presenting a passage into which the chimney 112 opens out.

The capsule 3 contains said smokable material 2, which is molded in the capsule against the bottom inside face of the capsule.

The smoking device includes a perforator 4 adapted to make at least one first hot air flow opening 31 through a wall of the capsule 3 when the capsule 3 is positioned in the recess of the upper bowl 10 and is bearing against said positioning surfaces 110.

More precisely, the perforator 4 includes at least one tube 41 provided with a cutting edge 410 formed at a first terminal end of the tube 41, this cutting edge being adapted to make a perforation P1 in the wall of the capsule 3.

The tube 41 is thus arranged to create said first hot air flow opening 31 through the wall of the capsule.

As shown in FIG. 2, the tube 41 opens out facing the chimney 12 so as to allow a stream F of hot air to flow between the tube 41 and the chimney 12.

The tube 41 also includes a lateral perforation 411 in the tube that opens out to the inside of said recess 11 that is shaped to receive said capsule 3, the tube being shaped to allow hot air to flow inside the tube between said lateral perforation 411 and said first terminal end of the tube 41.

Specifically, this lateral perforation 411 is shaped to open out into the capsule 3 when it is positioned/blocked in the recess 11 of the upper bowl 10.

The recess 11 of the upper bowl 10 extends between a low limit Lb and a high limit Lh located above said low limit. In other words, while the device is being used for smoking, the high limit Lh of the recess is located above the low limit Lb of the recess.

The lateral perforation 411 in the tube is closer to the high limit Lh of the recess than it is to the low limit Lb of the recess.

This serves to limit the risk of the lateral perforation 411 plunging into the material for smoking when the capsule is in the recess and has been perforated by the tube 41.

Figure 7:
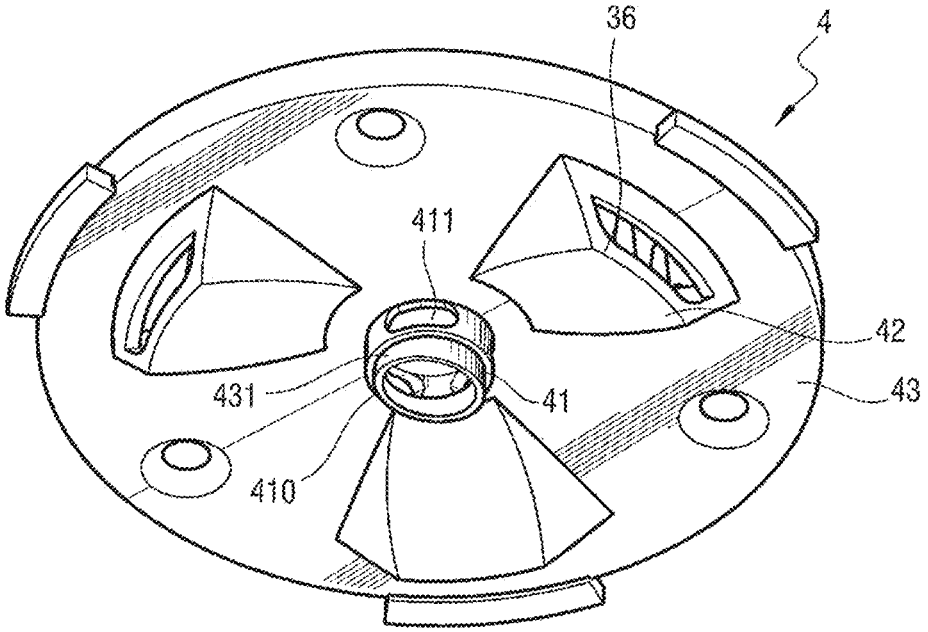
FIG. 7 is a perspective view of the bottom of the FIG. 6 perforator.
Figure 8:
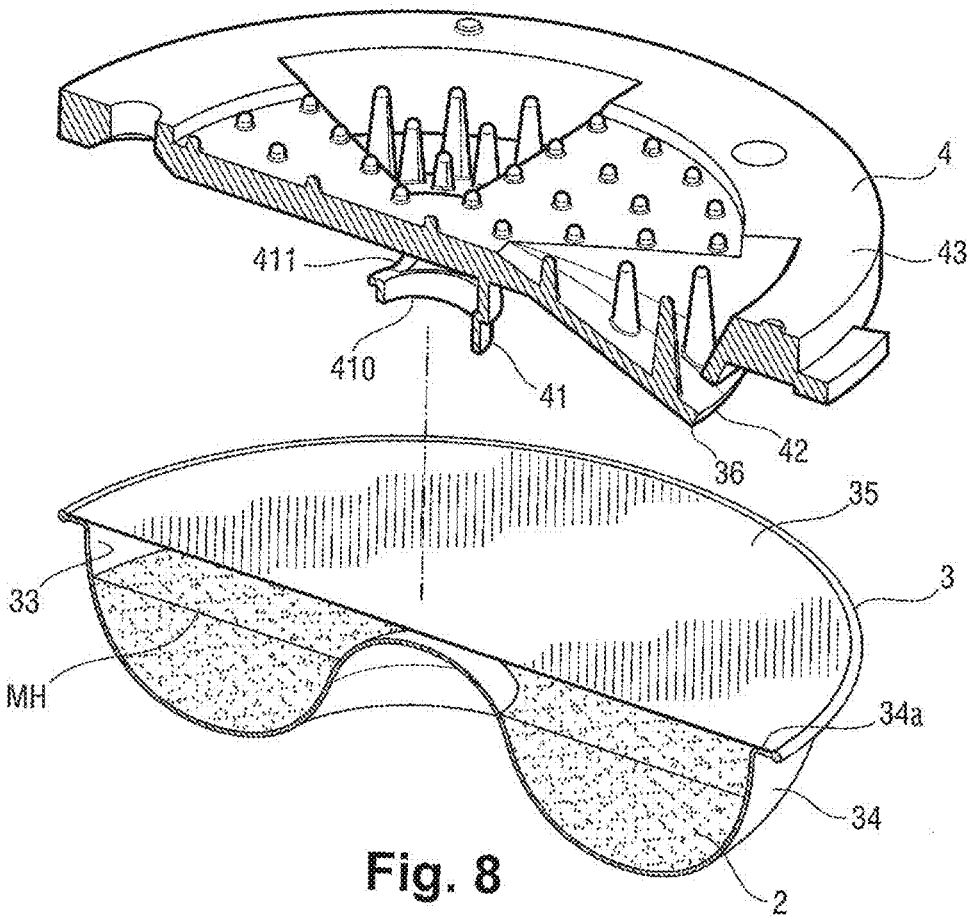
FIG. 8 is a perspective view showing the perforator lid and the un-perforated capsule.
Figure 9:
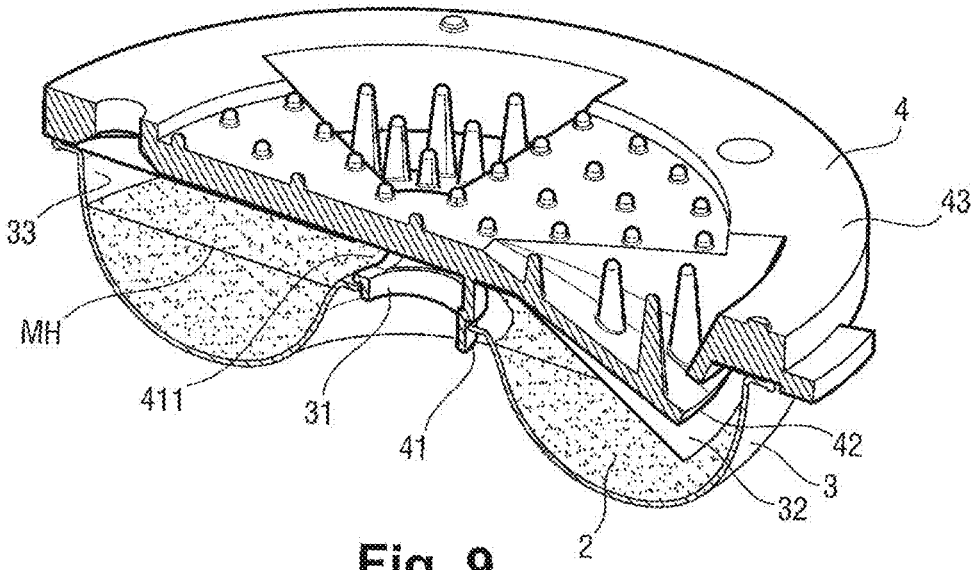
FIG. 9 is a perspective view showing the perforator lid and the capsule once the capsule has been perforated by the perforator lid.

As shown in FIGS. 2 and 3, the perforator 4 includes a perforator lid 43 having a first perforator portion 431 (see the detail in FIG. 7). The perforator lid 43 is arranged to shut at least in part a passage for inserting the capsule into said recess 11 of the upper bowl.

The passage is formed between a zone external to said upper bowl 10 and said recess of the upper bowl in order to allow the capsule to be inserted.

The lid 43 can be removably assembled on the upper bowl 10 in order to disengage the capsule-insertion passage selectively.

Thus, the capsule is positioned in removable manner in the recess in order to be capable of being extracted from the recess once the perforator lid has been removed and the passage has been released.

The lid 43 is arranged so that when it is in position to shut, at least in part, the passage for inserting the capsule, then its first perforator portion 431 is oriented so as to be able to extend into the recess so as to be able to pass through the wall of the capsule 3 that has been placed in the recess. This first perforator portion is thus arranged to define said at least one first hot air flow opening 31 through the capsule wall.

In this example, the first perforator portion 431 is formed by said tube 41, which tube presents a second terminal end that is shut and that is connected to the perforator lid 43. The first terminal end carrying the cutting edge 410 opens out into the chimney 12 to form a sealed connection between the chimney 12 and the periphery of the first terminal end of the tube 41.

This sealed connection may be made by appropriately selecting the material of the chimney 12 and of the tube 41 so as to obtain sealing by the tube engaging in the chimney or by using at least one gasket that extends between the chimney and the tube.

Thus, the tube 41 may be rigid, while the material of the chimney may be flexible, such as a silicone capable of withstanding high temperatures.

The perforator lid 43 is preferably made of a material that presents:

firstly a heat conductivity coefficient greater than 20 W·m−1·K−1 at a temperature of 20° C.; and secondly a melting temperature greater than 450° C.

The lid 43 can thus withstand the temperature that occurs during combustion of the material for smoking, while nevertheless making it possible, where appropriate, for heat to be transferred to the material for smoking that is to be found in the capsule in order to activate its combustion.

Typically, the material of the lid may be selected from aluminum, mild steel, stainless steel, titanium, copper, brass, bronze, and alloys thereof.

In order to facilitate the transfer of heat from the lid to the capsule, the lid may present shapes that are complementary to the top outside face of the capsule so as to bear against said top face when the capsule is in the recess 11 and so that the lid shuts the capsule-insertion passage.

As shown in FIGS. 1, 2, and 3, the device also includes a heating chamber 5, the heating chamber being separated from said recess 11 formed in the upper bowl 10 by said perforator lid 43.

In this example, the heating chamber 5 is a volume defined by an outer peripheral wall. A first end of the chamber 5 is open towards the perforator lid 43.

A second end of the heating chamber is shut in part by a cover presenting vents of section that can be adjusted by moving a shutter of the cover (in this example the shutter is pivotally mounted and it is moved by using a handle).

As shown in FIG. 3, fastener screws, three fastener screws in this example, are used for assembling the lid 43 against the rim of the outer peripheral wall defining the heating chamber 5.

This is useful for facilitating heat conduction while also enabling the heating chamber 5 to be disassembled.

As shown in FIGS. 2, 3, 8, 9, and 10, the capsule 3 has a wall defining an inside space 33 of the capsule, this inside space containing a volume of smokable material 2.

This wall of the capsule is constituted:

by a cup 34 presenting a bottom and an annular peripheral wall of the cup, the annular peripheral wall defining a top opening 34*a* of the cup 34; and by a membrane seal 35 closing the top opening 34*a* of the cup 34.

The volume of smokable material 2 is placed in the cup against the bottom of the cup and it defines a substantially plane top level NH of smokable material inside the capsule.

This top level NH is at a distance from the membrane seal 35.

The bottom of the cup 34 presents a central zone Zc that rises above the volume of smokable material 2 and above said top level NH of smokable material (in this example this top level NH is in the shape of a plane disk).

The recess 11, the capsule 3, and the perforator 4, which in this example is in the form of a perforator lid 43, are shaped so that when the capsule is in the recess 11 and the perforator 4 shuts, at least in part, the passage for inserting the capsule into the recess, then a first portion 41 of the perforator (in this example a tube 41) passes through the wall of the capsule in said central zone of the bottom of the cup 34 in order to form therein said at least one first hot air flow opening 31.

It can be seen that the perforator passes right through the capsule, initially perforating the membrane seal 35 and then perforating the central zone in the bottom of the cup so as to be able to obtain a first flow opening 31 facing the chimney 12.

The perforator 4 also passes through the wall of the capsule 3 in order to form therein, at a distance from the first hot air flow opening 31, at least one second hot air flow opening 32 so as to form a hot air flow baffle inside the capsule 3.

For this purpose, and as shown in FIGS. 3, 7, 8, and 9, the perforator lid 4 has a second perforator portion 42 arranged to make said at least one second hot air flow opening 32 when the capsule is in position in the recess 11 and the perforator lid 4 is positioned against the upper bowl 10 in order to shut, at least in part, the capsule-insertion passage. Preferably, each second perforator portion 42 that is arranged to make a second hot air flow opening 32 presents, facing towards the capsule, a face that is a portion of a frustoconical surface.

It should be observed that the face of the perforator lid 4 facing towards the heating chamber presents heat conduction studs. The terminal ends of the studs extend to a common plane, and together they define a bearing plane for combustible material (coals in this example). It should be observed that each second perforator portion 42 carries a plurality of these studs.

The perforator 4 is arranged so that each of said at least one second hot air flow opening 32 is an opening for admitting air into the capsule and is formed through the membrane seal 35 of the capsule 3, above the high level NH of the volume of smokable material inside the capsule and at the periphery of the membrane seal.

Thus, when said at least one first hot air flow opening 31 is made in the central zone Zc of the bottom of the cup 34, each at least one second hot air flow opening 32 is formed in a peripheral portion of the membrane seal 35. This creates an air flow baffle inside the capsule that is placed exclusively above the high level NH of the volume of smokable material.

Figure 10:
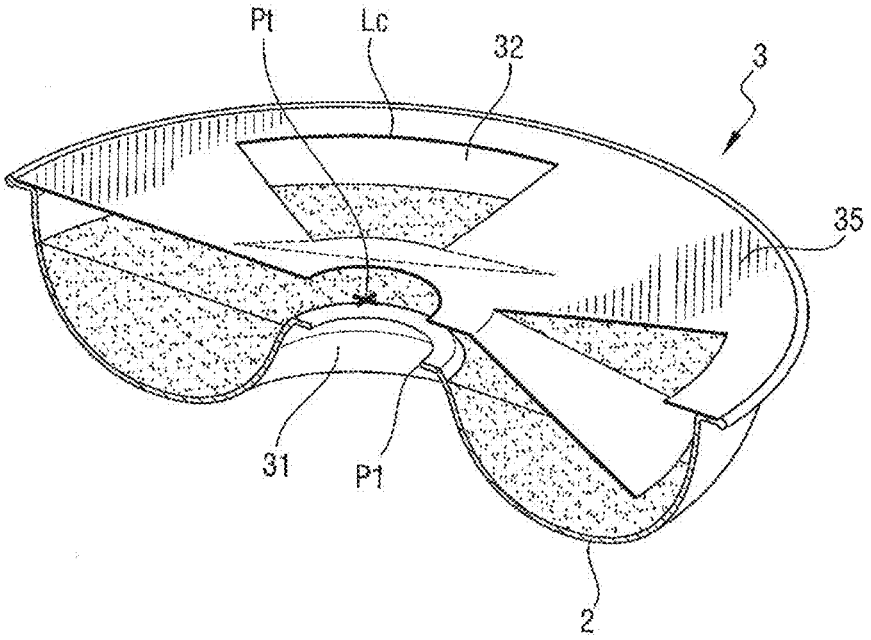
FIG. 10 is a perspective view of the capsule after the central zone of the bottom of the cup has been perforated and after making perforations in the membrane seal of the capsule.

More precisely, and as shown in FIG. 10, after the membrane seal 35 has been perforated by the perforator 4, it can be seen that there are three second openings 32 that are distinct from one another and spaced apart at 120°.

Each of these openings 32 is made by cutting the membrane seal along a line of cut that is made up of a circular line extending at a constant distance from a central point of the capsule together with two straight lines defining respective ends of the circular line.

As shown in FIG. 10, the line of cut does not form a loop so that the portion(s) of the membrane seal 35 as cut out in this way remain(s) attached to the remainder of the membrane seal via a link portion formed between the circular line LC and the central point Pt of the capsule.

Each membrane seal portion as cut out in this way forms a flap that dips into the capsule, going from the center towards the periphery of the capsule. Each flap as formed in this way by creating one of the second openings 32 serves to form a baffle in the capsule 3. Each baffle limits any exit of smokable material from the capsule through an opening 32, while also contributing to good distribution of hot air inside the capsule. The membrane seal portion as cut out in this way and forming a flap remains attached to the remainder of the capsule and forms a screen protecting the perforator 4 by preventing contact between the smokable material and the perforator 4.

In other words, the shape of the perforator is adapted to make a cut in the membrane seal in such a manner that each membrane seal portion as cut out in this way forms a flap dipping into the capsule, with each flap as formed in this way remaining attached to the remainder of the capsule by a link portion between the flap and the remainder of the membrane seal so as to prevent contact between the smokable material and the portion(s) of the perforator 4 to be found inside capsule.

For this purpose, the perforator lid is assembled on the upper bowl via an assembly enabling relative pivoting of the lid against the upper bowl, between a first pivot position in which the lid perforates the wall of the capsule 35 and a second pivot position in which the perforations are enlarged in order to form said first and second hot air flow openings.

Figure 6:
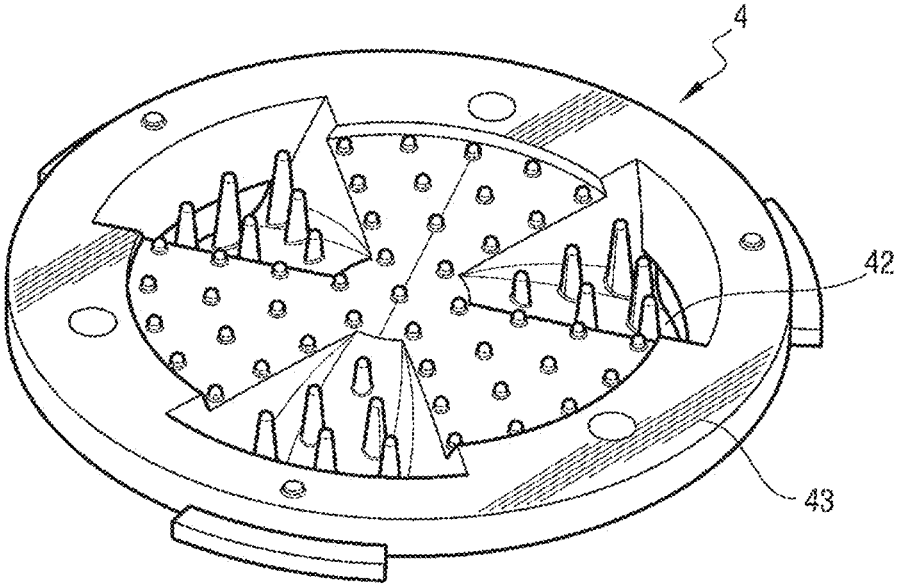
FIG. 6 is a perspective view of the top of the perforator forming a perforator lid, which lid is adapted to close partially the recess in which the capsule is to be found, to perforate the capsule that is to be found in the recess, and to define the heating chamber that is to receive coals/embers or a heater resistor.

In the embodiment described, this assembly is a bayonet assembly. Specifically, and as shown in FIGS. 3, 6, and 7, the lid 4 presents three peripheral bayonet studs that are spaced apart at 120°, and the upper bowl has three slots likewise spaced apart at 120°. Each of the bayonet studs penetrates into a corresponding one of the slots and can slide therein when the lid passes between its first and second pivot positions.

Alternatively, the lid could be assembled on the upper bowl by means of threads (screw-and-nut assembly).

The tube 41 having the cutting edge 410 has the outside shape of a right cylinder centered on the lid and extending along an axis of revolution of the lid. On passing between its first and second pivot positions, the lid pivots relative to the upper bowl about this axis of revolution.

Three cutting shapes 36, each having a circular cutting edge, are formed under the perforator lid 43. Each of these shapes 36 is used to make a corresponding one of the second openings 32 during pivoting of the lid.

By means of this symmetrical arrangement of the second openings 32 around the first opening 31, the combustion limit surface inside the capsule moves uniformly throughout combustion.

The combustion limit surface is the surface defining the boundary between a volume of smokable material that has already been burnt and a volume of smokable material that remains to be burnt. This combustion limit surface advances inside the capsule, starting from a high level NH and going towards the bottom of the cup. Since the smokable material is arranged in a ring around the central zone Zc, the combustion limit forms a uniform hollow disk around the central zone.

The invention is not limited to the above description, and it may combine certain of the embodiments of the device, of the assembly, and of the capsule as described above.

For example, the above-described heating chamber 35 is formed above the recess 11 and it is separated from the recess 11 by the perforator lid.

Nevertheless, it is equally possible for the heating chamber to be formed on the sides of the recess 11, or under it.

Likewise, heating may be obtained using a heater device, e.g. such as a heater resistor, that does not necessarily require a heating chamber.

Thus, it is possible to envisage the lid incorporating such a resistor.

It is also possible to envisage the heater resistor merely being placed in the heating chamber made in accordance with any of the embodiments of the heating chamber as described above.

The invention claimed is:

1. A smoking device for smoking a smokable material, the device comprising an upper bowl presenting a recess for having the smokable material positioned therein and a chimney opening out into the inside of the upper bowl in order to collect therefrom the smoke generated by combustion of said smokable material, said upper bowl including, inside the recess, positioning surfaces arranged to be capable of positioning a capsule inside the recess of said upper bowl, the capsule containing said smokable material, the smoking device being characterized in that it includes a perforator adapted to make at least one first hot air flow opening through a wall of the capsule when the capsule is positioned in the recess of the upper bowl and is bearing against said positioning surfaces, and wherein the perforator includes at least one tube provided with a cutting edge formed at a first terminal end of the tube, the cutting edge being adapted to make a perforation in the wall of the capsule, the tube being arranged to create said first hot air flow opening through the wall of the capsule, the tube opening out facing the chimney to enable a stream of hot air to flow between the tube and the chimney.

2. The smoking device according to claim 1, wherein said first terminal end of the tube opens out facing the chimney to enable said stream of hot air to flow between the tube and the chimney, and the tube includes a lateral perforation in the tube opening out to the inside of said recess that is shaped to receive said capsule, the tube being shaped to enable hot air to flow inside the tube between said lateral perforation and said first terminal end of the tube.

3. The smoking device according to claim 2, wherein said recess of the upper bowl extends between a low limit and a high limit lying above said low limit, the lateral perforation in the tube being closer to the high limit of the recess than it is to the low limit of the recess.

4. The smoking device according to claim 1, wherein the perforator includes a perforator lid including a first perforator portion, the perforator lid being arranged to shut, at least in part, an insertion passage for inserting the capsule into said recess of the upper bowl, said passage being formed between a zone outside said upper bowl and said recess of the upper bowl while its first perforator portion is oriented so as to be capable of extending through the wall of the capsule in order to define therein said at least one first hot air flow opening.

5. The smoking device according to claim 4, wherein the perforator lid is made of a material presenting:

firstly a heat conductivity coefficient greater than 20 W·m−1·K−1 at a temperature of 20° C.; and secondly a melting temperature greater than 450° C.

6. The smoking device according to claim 4, further including a heating chamber, the heating chamber being separated from said recess formed in the upper bowl by said perforator lid.

7. An assembly comprising a device according to claim 1, and a capsule presenting a wall defining an inside space internal to the capsule and containing a volume of smokable material, the capsule being placed inside the recess of said upper bowl and bearing against said positioning surfaces, the perforator passing through the wall of the capsule and defining at least one first hot air flow opening through the wall of the capsule.

8. The assembly according to claim 7, wherein the perforator passes through the wall of the capsule and, in addition to said at least one first hot air flow opening, it also makes therein at least one second hot air flow opening, said at least one first hot air flow opening and said at least one second hot air flow opening being distinct from each other and being spaced apart from each other in such a manner as to form a baffle inside the capsule.

9. The assembly according to claim 8, wherein the capsule wall comprises:

a cup presenting a bottom and an annular peripheral wall of the cup, this annular peripheral cup wall defining a top opening of the cup; and a membrane seal closing the top opening of the cup;

the volume of smokable material being placed in the cup against the bottom of the cup and defining a high level of smokable material inside the capsule, the high level being at a distance from said membrane seal;

said first hot air flow opening being an outlet opening for discharging smoke and being formed through the wall of the capsule above said high level of smokable material in the capsule; and said second hot air flow opening being an inlet opening for admitting air into the capsule and being formed through the wall of the capsule above the high level of smokable material in the capsule.

10. A method of using a smoking device for smoking a smokable material according to claim 1, the method comprising:

putting a capsule into place inside the recess of said upper bowl, the capsule presenting a wall defining an inside space internal to the capsule, the inside space containing a volume of smokable material, the wall of the capsule bearing against said positioning surfaces, the wall of the capsule comprising a cup and a membrane seal closing a top opening of the cup, the volume of smokable material being placed in said cup against the bottom of the cup and defining a high level of smokable material inside the capsule, the high level being at a distance from said membrane seal; and then generating a stream of hot air inside the capsule from a second hot air flow opening to a first hot air flow opening, these first and second hot air flow openings being formed through the wall of the capsule above the high level of smokable material and being spaced apart from each other.

11. The method according to claim 10, wherein, after the capsule has been put into place inside the recess of said upper bowl, the method includes making said first and second hot air flow openings, the first and second openings being made using a perforator forming a perforator lid that shuts, at least in part, an insertion passage for inserting the capsule into said recess of the upper bowl, the passage being formed between a zone outside said upper bowl and said recess of the upper bowl.

12. The method according to claim 11, wherein the perforator lid includes at least one tube provided with a cutting edge formed at a first terminal end of the tube and adapted to perforate the wall of the capsule, said first hot air flow opening being created by pushing the tube through the wall of the capsule, and once the capsule has been perforated in this way, the tube opens out outside the capsule facing the chimney so as to enable a stream of hot air to flow between the tube and the chimney, a lateral perforation in the tube then being situated inside the capsule above said high level of smokable material, and each at least one second opening being formed through the membrane seal of the capsule by a cutting shape carried by said perforator lid.

* * * * *